US007926656B2

(12) United States Patent
Hinds

(10) Patent No.: US 7,926,656 B2
(45) Date of Patent: Apr. 19, 2011

(54) FABRIC DISPLAY PACKAGE

(76) Inventor: Donna K. Hinds, Los Angeles, CA (US)

( * ) Notice: Subject to any disclaimer, the term of this patent is extended or adjusted under 35 U.S.C. 154(b) by 274 days.

(21) Appl. No.: 12/001,314

(22) Filed: Dec. 10, 2007

(65) Prior Publication Data

US 2009/0145798 A1 Jun. 11, 2009

(51) Int. Cl.
*B65D 73/00* (2006.01)
*B65D 85/00* (2006.01)

(52) U.S. Cl. ..... 206/459.1; 206/457; 206/494

(58) Field of Classification Search ..... 206/775, 206/293, 49, 497, 457, 451, 494, 459.1; 220/125.02, 220/125.38; D9/418, 419, 423; 229/125.02, 229/125.38

See application file for complete search history.

(56) References Cited

U.S. PATENT DOCUMENTS

| | | | | | |
|---|---|---|---|---|---|
| 1,203,442 | A | * | 10/1916 | Wister | 190/27 |
| 1,922,969 | A | | 8/1933 | MacColl | |
| 2,612,260 | A | | 9/1952 | Schoenhut | |
| D175,299 | S | * | 8/1955 | De Mond | D9/631 |
| 2,771,237 | A | * | 11/1956 | Philipson | 229/125.22 |
| 3,370,779 | A | * | 2/1968 | Cole | 229/125.22 |
| 3,577,604 | A | * | 5/1971 | Brosk | 24/339 |
| 3,595,382 | A | * | 7/1971 | Hofer | 206/215 |
| 4,374,877 | A | * | 2/1983 | Cole | 428/9 |
| RE32,443 | E | * | 6/1987 | Kalal | 206/459.1 |
| 4,733,808 | A | * | 3/1988 | Turner et al. | 224/219 |
| D329,601 | S | * | 9/1992 | Samelson | D9/721 |
| 5,193,675 | A | * | 3/1993 | Otis | 206/278 |
| D382,476 | S | * | 8/1997 | Bell | D9/629 |
| 6,126,068 | A | | 10/2000 | Faircloth et al. | |
| 6,773,062 | B2 | * | 8/2004 | Illulian | 297/228 |
| 7,000,771 | B2 | * | 2/2006 | Kwong | 206/575 |
| 7,347,323 | B2 | * | 3/2008 | Kim | 206/278 |
| 7,503,456 | B2 | * | 3/2009 | Rodriguez | 206/769 |
| 2005/0236299 | A1 | | 10/2005 | Weber et al. | |

OTHER PUBLICATIONS

[http://www.mygiftee.com/aromatique-orange-evergreen.html] Giftee, LLC. (see included NPL photographs as extrinsic evidence).*

* cited by examiner

*Primary Examiner* — Mickey Yu
*Assistant Examiner* — Melissa L Lalli
(74) *Attorney, Agent, or Firm* — Christie, Parker & Hale, LLP

(57) ABSTRACT

A product display package has a closure made from an elongated ribbon of fabric which wraps around the outside of the package. An elastic band attaches to opposite ends of the ribbon for tightening the fabric strip around the package. The ribbon of fabric is made from a material that corresponds to that of the enclosed article.

2 Claims, 3 Drawing Sheets

FABRIC DISPLAY PACKAGE

FIELD OF INVENTION

This invention relates to product display packaging. More particularly, the invention is concerned with a display package for articles made of textile fabrics such as sheets or pillow cases or similar types of linens.

BACKGROUND

Linen products are commonly sold in clear vinyl packages so the customer can visually inspect the color or pattern of the product without opening the package. Certain types of linen products are preferably sold in boutiques or apothecary stores offering beauty and skin care products. These may include pillow cases and sheet sets where the fabrics from which they are made have a certain level of softness and texture that promote skin care. Pillow cases and sheets made from silk are an example.

These beauty and skin care products may be contained in a clear plastic package or other means of allowing the customer to visually inspect the product. These products are often folded neatly and the store owner wants to avoid customers opening the package and unfolding the item to inspect the material. However, inspecting these particular products is highly desirable.

The present invention provides a display package which allows the customer to inspect the fabric by touching or feeling it without opening the package.

SUMMARY OF THE INVENTION

The present invention provides a display package comprising a container having a bottom panel with upright side walls and a lid for enclosing the container. A folded article made of a fabric material is disposed in the container. The fabric may be visible through the clear plastic lid. A flexible and removable closure is tightly wrapped around the container and over the lid. The closure comprises in elongated ribbon made of a fabric material that matches the fabric material of the article in the container. An elongated elastic band is affixed to opposite ends of the ribbon for being stretched to hold the ribbon under tension around the outside of the container. The fabric material provided by the outer ribbon allows closely inspecting the material from which the product is made without necessitating removal of the item from the package. The closure may be removed from the package to allow for more easily inspecting the fabric material.

This display package combination is particularly useful in skin care and beauty supply boutiques and apothecary stores carrying such products made from fabrics which, by their nature, necessitate careful inspection by the customer prior to purchasing the product.

These and other aspects of the invention will be more fully understood are referring to the following detailed description and the accompanying drawings.

DETAILED DESCRIPTION

Figure 1:
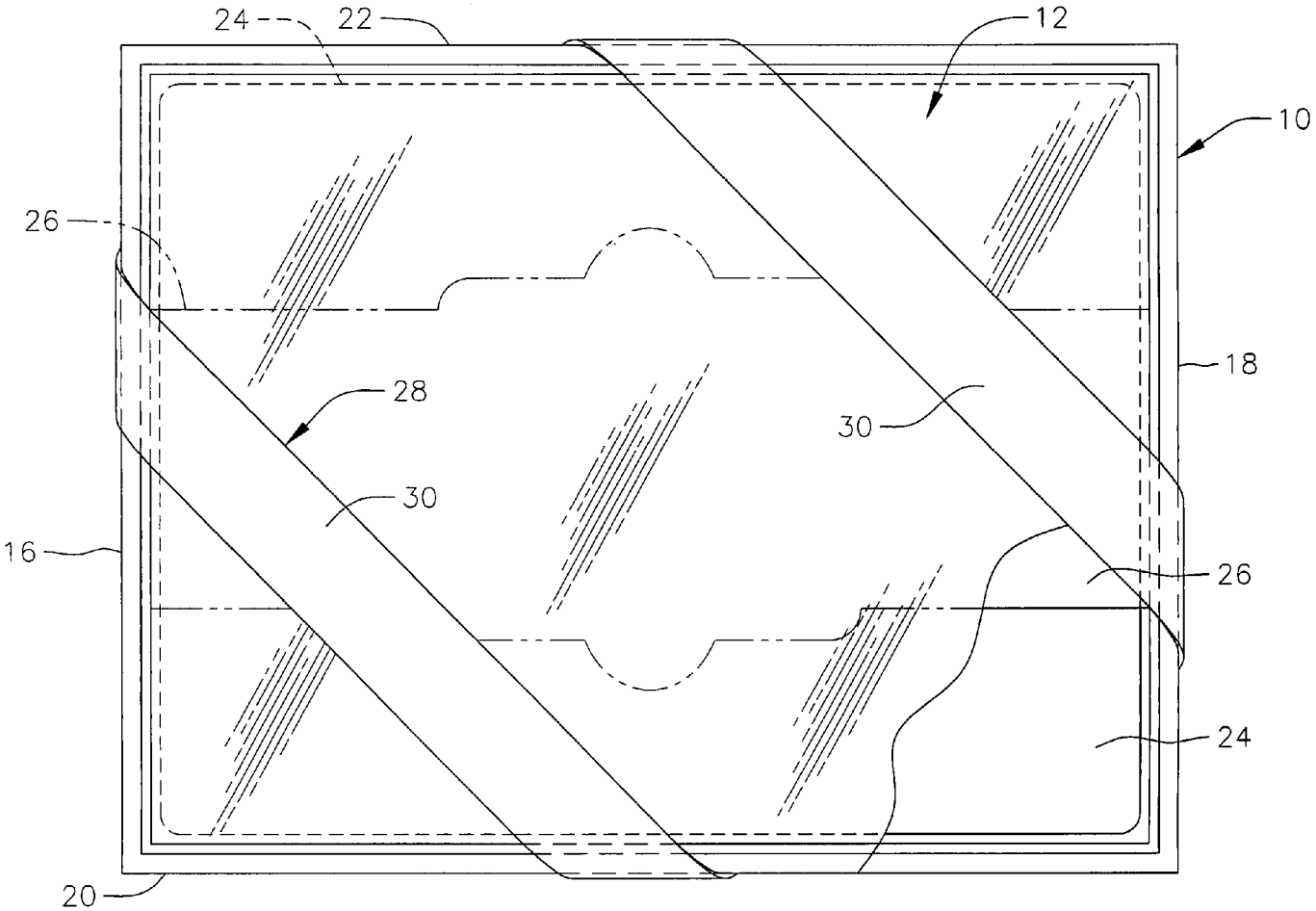
FIG. 1 is a top plan view, partly broken away, showing a product display package according to principles of this invention.

Referring to FIG. 1, a display package comprises a bottom container 10 and a lid 12 preferably made from a transparent plastic material. The bottom container is generally rectangular in shape and includes a rectangular flat bottom panel 14 with upright left and right sidewalls 16, 18 and front and rear walls 20, 22, respectively. The walls are of uniform height and encompass an upwardly opening void space within the container.

The clear plastic lid 12 has a similar rectangular structure with left and right side walls and front and back walls. The clear plastic lid, in one embodiment, is sized slightly smaller than the rectangular container so the walls of the lid fit inside the walls of the container when the lid is placed over an article in the void space within the container. However, in an alternate embodiment, the outer walls of the clear plastic lid may fit around the upright walls around the periphery of the container.

FIG. 1 illustrates an example of an article 24 which can be contained in the package. The package is uniquely suited for holding and displaying linen type products made for skin care or beauty supply industry. Such products may include pillow cases, sheets or other fabric products which may come into contact with the skin during use. In one embodiment, the products are made of silk because of its unique properties in promoting skin care when the skin comes into prolonged contact with the material. In the illustrated embodiment, the article in the container comprises a tightly folded pillow case made of silk, but sheet sets also made of silk may be displayed in the container.

The article 24 in its folded condition is also loosely wrapped in a flexible sleeve 26 which is visible through the clear plastic lid. The sleeve is preferably made of paper or plastic and contains printed information and other data about the product which are visible through the lid.

A stretchable ribbon type closure 28 is wrapped around the exterior of the display package. The closure comprises in a elongated thin, flat and flexible ribbon 30 and a short thin and flat flexible elastic band 32 affixed to opposite ends of the ribbon. The closure is removably positioned around the outside of the package, held in tension by the elastic band. The ribbon portion of the closure is preferably made from a fabric type material which is identical to that of the article contained in the package. The ribbon is preferably of uniform width from end to end, although other configurations are possible. The ribbon 30 is of sufficient width so that a useful amount of material for purposes of this invention is provided by the ribbon.

Figure 3:
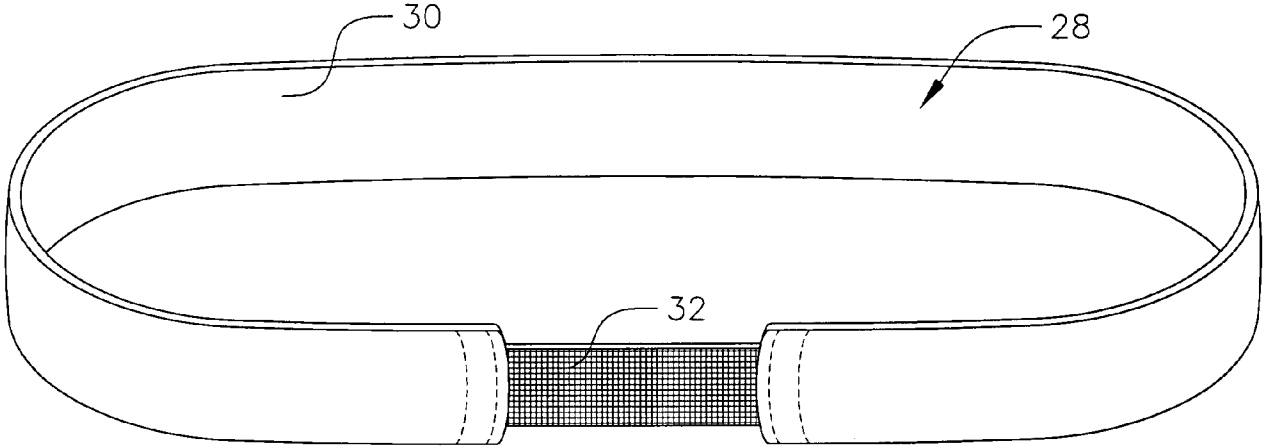
FIG. 3 is a perspective view showing an elastic band and ribbon fabric construction used in combination with the display package.
Figure 4:
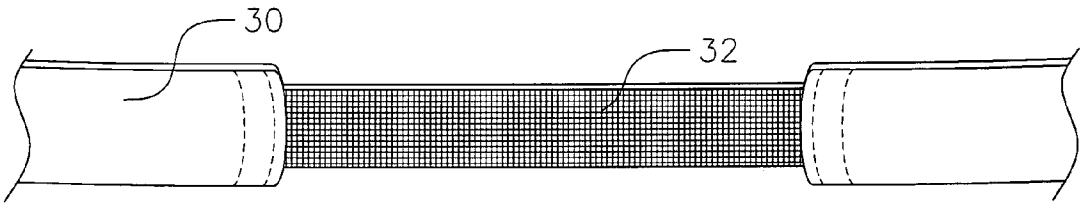
FIG. 4 is a fragmentary perspective view, similar to FIG. 3, showing a stretched position of the elastic band.

FIG. 3 shows a perspective view of closure 28 in its non-tensioned position. The elongated ribbon 30 extends for a majority of the length of the closure, and the elastic band 32 is preferably narrower in width and substantially shorter. The ends of the elastic band are affixed to corresponding ends of the ribbon by stitching 34 or any other means of securely fastening the flat overlying faces of the ribbon and the elastic band. In one embodiment, the elastic band in its non-tensioned position does not extend for a length more then about 20% of the overall length of the closure. FIG. 4 shows the elastic band in its stretched or tensioned position in which the band stretches at least about 50% greater than its original long dimension.

Figure 2:
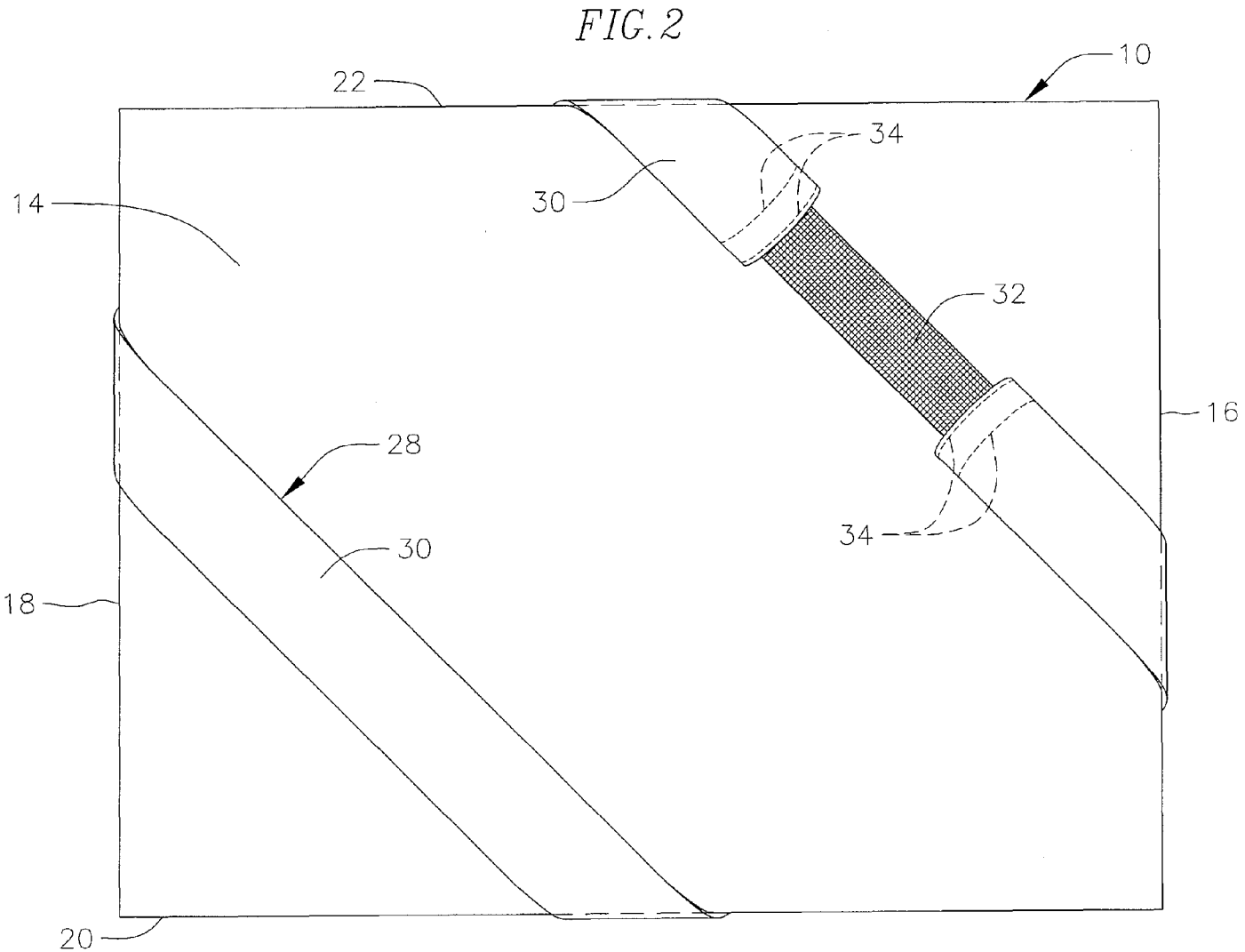
FIG. 2 is a bottom plan view taken from the opposite side of FIG. 1.

FIGS. 1 and 2 best illustrate the use position of the display package and its elastic closure. The closure is of sufficient length to fit around the exterior of the package with the ribbon 30 extending diagonally across opposite corners of the package as shown in FIG. 1. The closure is positioned so the elastic band is positioned on the rear side of the container, as shown in FIG. 2, when the closure is in the use position.

FIG. 3 shows the closure in its at-rest position removed from the container.

FIG. 4 shows the elastic band 32 stretched fully to its extended position which allows the closure to be easily manipulated to fit it around the container or be easily removed from the container.

The invention provides an effective means of allowing the customer to inspect the fabric material contained in the product without opening the package. The elastic band can be easily removed from the package so the material can be more closely inspected. The closure also can be easily wrapped around the package when replacing it in the use position shown in FIG. 1.

The stretchable ribbon fabric type closure is useful for matching fabric type products made from the same fabric but in different colors or patterns. The closures can be separately manufactured with ribbon fasteners in different colors and then later matched up with the packaged products which maybe separately manufactured and packaged.

Although the present invention has been described with respect to linen type products, and more particularly those of the skin care or beauty items sold in apothecary or beauty supply stores, the invention also is useful in display packaging of other types of materials where the characteristics or properties of the packaged article can be inspected without removing the product from the container.

What is claimed is:

1. A skin care product display package comprising:

a upwardly opening container having a bottom panel and upright side walls around its periphery, a clear plastic lid removably disposed in or around the periphery of the side walls to cover an opening in the container and provide an open space within the container, a folded article disposed in the open space within the container and visible through the clear plastic lid, the article comprising a pillow case made of a silk fabric or a sheet made of a silk fabric, and a flexible closure removably positioned around the container and lid combination, the closure comprising an elongated ribbon made from a same silk fabric as the article disposed in the container, and an elongated elastic band affixed to opposite ends of the ribbon for being stretched to hold the ribbon of silk fabric under tension wrapped around an outside of the container, the closure removable from the container to facilitate a customer's inspecting the silk fabric corresponding to the article disposed in the container.

2. The display package of claim 1 in which the article disposed in the container is a folded pillow case.

* * * * *